US009010284B2

(12) United States Patent
Ichihashi

(10) Patent No.: US 9,010,284 B2
(45) Date of Patent: Apr. 21, 2015

(54) ENGINE AND ENGINE POWER TOOL

(71) Applicant: Hitachi Koki Co., Ltd., Tokyo (JP)

(72) Inventor: Naoto Ichihashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 13/789,551

(22) Filed: Mar. 7, 2013

(65) Prior Publication Data

US 2013/0239914 A1 Sep. 19, 2013

(30) Foreign Application Priority Data

Mar. 15, 2012 (JP) ..... 2012-058234

(51) Int. Cl.

*F01P 1/02* (2006.01)
*F01P 1/00* (2006.01)
*F01P 9/00* (2006.01)

(52) U.S. Cl.

CPC ... *F01P 1/00* (2013.01); *F01P 1/02* (2013.01); *F01P 9/00* (2013.01)

(58) Field of Classification Search

CPC ..... F01P 1/00; F01P 1/02; F01P 7/00; F01P 7/02; F01P 11/01; F02M 15/06; F02B 77/11

USPC ..... 123/41.31, 41.52, 41.56, 41.58, 195 R, 123/195 A, 198 R, 572, 573

See application file for complete search history.

(56) References Cited

U.S. PATENT DOCUMENTS

| | | | | |
|---|---|---|---|---|
| 2,444,103 | A * | 6/1948 | Kuhn | 123/77 |
| 2,796,053 | A * | 6/1957 | Lechtenberg | 123/41.65 |
| 4,332,220 | A * | 6/1982 | Itzrodt | 123/41.7 |
| 6,382,169 | B1 * | 5/2002 | Gausman | 123/195 R |
| 6,427,672 | B1 * | 8/2002 | Ito et al. | 123/572 |
| 6,761,136 | B2 * | 7/2004 | Ohsawa | 123/41.56 |
| 7,341,027 | B2 * | 3/2008 | Sugiyama | 123/41.65 |
| 7,363,886 | B2 * | 4/2008 | Akaike et al. | 123/41.65 |
| 8,627,900 | B2 * | 1/2014 | Oomori et al. | 173/217 |
| 2009/0293821 | A1 * | 12/2009 | Nakamizo | 123/41.65 |
| 2010/0199931 | A1 * | 8/2010 | Kurzenberger et al. | 123/41.65 |
| 2012/0132180 | A1 * | 5/2012 | Vick | 123/545 |
| 2012/0291725 | A1 * | 11/2012 | Kurzenberger et al. | 123/41.65 |

FOREIGN PATENT DOCUMENTS

JP 2001-123888 A 5/2001

* cited by examiner

*Primary Examiner* — Lindsay Low
*Assistant Examiner* — Grant Moubry
(74) *Attorney, Agent, or Firm* — McDermott Will & Emery LLP

(57) ABSTRACT

The cooling effect of an engine is improved. An engine, which rotationally drives a saw chain serving as a rotating tool, is provided with a crankcase, in which a crankshaft is rotatably built, and a cylinder, in which a piston coupled to the crankshaft via a connecting rod is reciprocatably built. Atop part of the cylinder is covered with a cylinder cover, and a cooling wind toward the cylinder is generated by a cooling fan attached to a projecting end of the crankshaft. The cooling wind is guided by heat-dissipating plates extending along the crankshaft. Exposing parts bulged to outside than a lateral side of the cylinder cover are provided to tips of the heat-dissipating plates.

10 Claims, 4 Drawing Sheets

ENGINE AND ENGINE POWER TOOL

CROSS-REFERENCE TO RELATED APPLICATION

The present application claims priority from Japanese Patent Application No. 2012-058234 filed on Mar. 15, 2012, the content of which is hereby incorporated by reference into this application.

TECHNICAL FIELD OF THE INVENTION

The present invention relates to an engine mounted on a portable type engine power tool such as a chain saw or a power cutter and to the engine power tool.

BACKGROUND OF THE INVENTION

Examples of a hand-held type or a portable type engine power tool using an engine as a drive source include a chain saw and a power cutter. In the chain saw, a saw chain, which is a chain-shaped saw blade for cutting a working object such as timber is provided in a power-tool main body. In the power cutter, a disk cutter for groove-forming or cutting of stone materials or concrete is provided in a power-tool main body. An engine mounted on such an engine power tool has an engine main body including a crankcase, to which a crankshaft is rotatably attached, and a cylinder, in which a piston is linearly reciprocatably built, and a cooling fan is attached to a first projecting end of the crankshaft so that the engine serves as a forcedly air-cooled engine. Cooling winds generated by the cooling fan are blown along the engine toward the opposite side of the engine with respect to the cooling fan to forcibly cool the engine. Since rotation of the cooling fan is stopped when the engine is stopped, the engine is cooled by natural air cooling after the engine is stopped.

To supply air-fuel mixture (vapor) of fuel and air to the engine, a vaporizer is attached to the engine via an insulator. When the engine is stopped, the flow of the air-fuel mixture in the vaporizer and the insulator is also stopped. As a result, the cooling effects of the vaporizer and the insulator brought about by the air-fuel mixture disappear. Therefore, heat conduction from the cylinder occurs in the vaporizer via the insulator and the temperature of the vaporizer increases. When temperature increase of the vaporizer becomes too large, most of gasoline, i.e., fuel evaporates. Therefore, sufficient fuel cannot be supplied from the vaporizer to the engine, and it becomes difficult to re-start the engine. Particularly, the engine used in the portable type engine power tool is strongly required to be downsized and is required to shorten the insulator as much as possible. Therefore, in the portable type engine power tool, in addition to the need to efficiently carry out forcible air cooling during engine operation, it has been an important technical problem to suppress temperature increase of the vaporizer without increasing the length of the insulator.

Japanese Patent Application Laid-Open No. 2001-123888 describes an engine which is configured to facilitate natural air cooling of a vaporizer by attaching a heat-dissipating fin between the vaporizer and an insulator.

SUMMARY OF THE INVENTION

However, in the configuration in which the heat-dissipating fin is attached between the vaporizer and the insulator disposed inside a cylinder cover, the temperature of the heat-dissipating fin can be increased only to temperature at the same level as that of the vaporizer. Therefore, the temperature difference from the air is small, natural convection generated at the heat-dissipating fin becomes weak, and the heat-dissipating effect caused by natural air cooling cannot be sufficiently exerted. Moreover, a thin member having a high thermal conductivity is used as the heat-dissipating fin interposed between the vaporizer and the insulator, and the effect of sufficiently reducing the temperature increase of the vaporizer cannot be obtained also from the point that the heat of the insulator is immediately thermally conducted to the vaporizer.

To effectively carry out natural convection by using a heat-dissipating plate, an upper side of the heat-dissipating plate has to be opened to the air so that heat is not confined in the heat-dissipating plate. However, particularly in an engine power tool in which a handle is provided so as to cover an engine from the upper side like a chain saw or a power cutter, to protect the engine from a large amount of woodchips and dust and to protect hands and arms of an operator who holds the handle, the engine has to be covered with a cover by providing the cover between the engine and the handle. However, such a problem cannot be solved by conventional engines.

A preferred aim of the present invention is to improve the cooling effect of the engine.

An engine of the present invention is an engine having an engine main body including: a crankcase in which a crankshaft is rotatably built; and a cylinder in which a piston is reciprocatably built and coupled to the crankshaft via a connecting rod. The engine includes: a cylinder cover covering a top part of the cylinder; a cooling fan attached to a projecting end of the crankshaft and rotationally driven by the crankshaft; and a heat-dissipating plate provided to extend from a periphery of the cylinder toward an opposite end of the projecting end, in which an exposing part for exposing an upper side of the heat-dissipating plate to outside air is provided to a tip of the heat-dissipating plate.

In the engine of the present invention, the exposing part is more bulged to the outside than a vicinity of a lateral side or the lateral side of the cylinder cover. In the engine of the present invention, a handle part extending in a direction of the crankshaft is provided above the cylinder cover. In the engine of the present invention, the heat-dissipating plate is provided to extend along the cylinder from the projecting end toward an opposite end of the crankshaft and guides a cooling wind generated by the cooling fan. In the engine of the present invention, the heat-dissipating plate has a base part extending in a direction along the crankshaft and a tip guide part provided at a tip of the base part, extending in a transverse direction with respect to the crankshaft, and forming a cooling-air emission part between the tip guide part and the lateral side of the cylinder cover.

In the engine of the present invention, the heat-dissipating plate is disposed at an intake opening of the cylinder. In the engine of the present invention, the heat-dissipating plate is disposed between the intake opening of the cylinder and an insulator. In the engine of the present invention, the heat-dissipating plate is disposed between an exhaust opening of the cylinder and a muffler. In the engine of the present invention, the heat-dissipating plate includes a heat-dissipating plate of an intake side disposed in an intake opening side of the cylinder and a heat-dissipating plate of an exhaust side disposed in an exhaust opening side of the cylinder. In the engine of the present invention, the heat-dissipating plate of the exhaust side has an exhaust opening part for discharging a cooling wind. In the engine of the present invention, the heat-dissipating plate of the intake side has an exhaust opening part for discharging a cooling wind.

An engine power tool of the present invention includes a rotating tool to be subjected to rotary drive by the crankshaft, in which the rotating tool is rotationally driven by the above-described engine.

In the engine, which rotationally drives the rotating tool, the cooling fan is provided to the projecting end of the crankshaft to generate the cooling wind toward the cylinder, and the cooling wind is supplied toward a second end side of the crankshaft. The heat-dissipating plate extending from the periphery of the cylinder is disposed at an end opposite to an end of the crankshaft on the cooling fan side, and the exposing part of which upper side is exposed to outside air is formed at the tip of the heat-dissipating plate; therefore, the heat-dissipating effect of the heat-dissipating plate is enhanced by the exposing part. As a result, this is a structure that suppresses transmission of heat to the operating handle, and, at the same time, the heat-dissipating effect of the engine brought by the heat-dissipating plate can be enhanced even in natural cooling after the engine is stopped. Moreover, since the heat-dissipating plate is provided so as to extend along the cylinder from the end on the cooling fan side to the end on the opposite side of the crankshaft, the effect of the forcible cooling by guiding the cooling wind from the cooling fan by the heat-dissipating plate can be enhanced.

BRIEF DESCRIPTIONS OF THE DRAWINGS

DESCRIPTIONS OF THE PREFERRED EMBODIMENT

Figure 2:
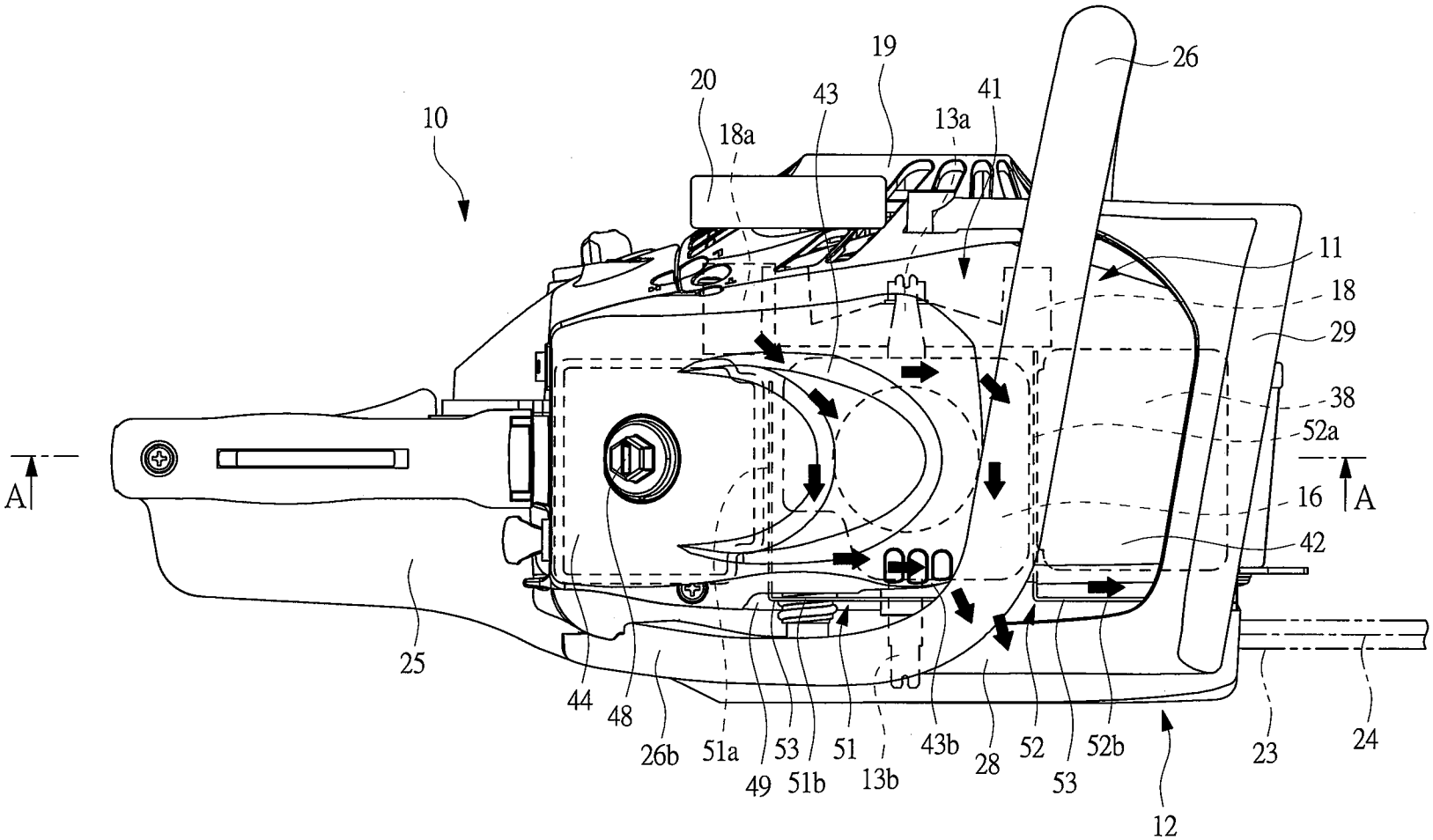
FIG. 2 is a plan view of FIG. 1.

Hereinafter, an embodiment of the present invention will be explained in detail based on the attached drawings. A chain saw 10 serving as an engine power tool has a power-tool main body 12, in which an engine 11 is built, as shown in FIG. 2. The engine 11 has an engine main body 11*a* including a crankcase 14 that includes a drive shaft, i.e., a crankshaft 13 rotatably built in, and a cylinder 16 that includes a piston 15 linearly and reciprocatably built in. Each of the crankcase 14 and the cylinder 16 is formed of an aluminum alloy. The piston 15 is coupled to the crankshaft 13 by a connecting rod 17, and the reciprocating motion of the piston 15 is converted to the rotating motion of the crankshaft 13.

As illustrated in FIG. 2, a cooling fan 18 is attached to a first projecting end 13*a* of a crankshaft 13, the cooling fan 18 is housed in a not-illustrated volute case attached to the power-tool main body 12, and a fan cover 19 is attached to the power-tool main body 12 so as to cover the volute case. A not-illustrated starting device, i.e., a recoil starter is provided inside the fan cover 19, and the engine 11 is started by operating an operating knob 20 of the recoil starter. A sprocket 22 is coupled to a second projecting end 13*b* of the crankshaft 13 via a not-illustrated centrifugal clutch in the manner shown in FIG. 3, and the sprocket 22 is rotatably attached to the crankshaft 13. A guide bar 23 is attached to the power-tool main body 12 as illustrated by double-dashed chain lines in FIGS. 1 and 2, a saw chain 24 serving as a rotating tool provided around the guide bar 23 is wound around the sprocket 22, and the saw chain 24 is rotationally driven by the engine 11 via the centrifugal clutch. In this manner, the first projecting end 13*a* side of the crankshaft 13 serves as a fan-driving-side end, and the projecting end 13*b* in the opposite side serves as a tool-driving-side end.

The engine main body 11*a* is attached to the power-tool main body 12 in a manner that the crankshaft 13 is in a transverse direction with respect to the power-tool main body 12. A rear handle 25 is provided at a rear part of the power-tool main body 12 so as to project to the rear side. A front handle 26 is disposed on the power-tool main body 12 so as to cross over the engine 11 from the first projecting end 13*a* side of the crankshaft 13 to the second projecting end 13*b* side of the crankshaft 13. A first end of the front handle 26, i.e., a leg part 26*a* on the fan side is fixed to a first front end of the power-tool main body 12, and a second end of the power-tool main body 12, i.e., a leg part 26*b* on the tool-driving side is fixed to the rear handle 25 by a screw member 27. The distance between the leg part 26*b* on the tool-driving side of the front handle 26 and the cylinder 16 is set to be shorter than the distance between the leg part 26*a* of the fan side and the cylinder. An operator holds the rear handle 25 with his/her right hand and carries out a cutting operation of a working object such as timber by the chain saw 10 in a state that a side part of the front handle 26 or an upper part of a cover main body 42 is held with his/her left hand. Aside cover 28 covering the above-described centrifugal clutch and the sprocket 22 is attached to the tool-driving side of the power-tool main body 12. The operator carries out the operation holding a lateral part, i.e., the cooling fan 18 side of the front handle 26 without holding the leg part 26*b* which is on the rotating tool side on which the saw chain 24 serving as a rotating tool, which rotates at a high speed, is disposed. A hand guard 29 is provided on the power-tool main body 12 bulging to the front side more than the front handle 26.

Figure 4:
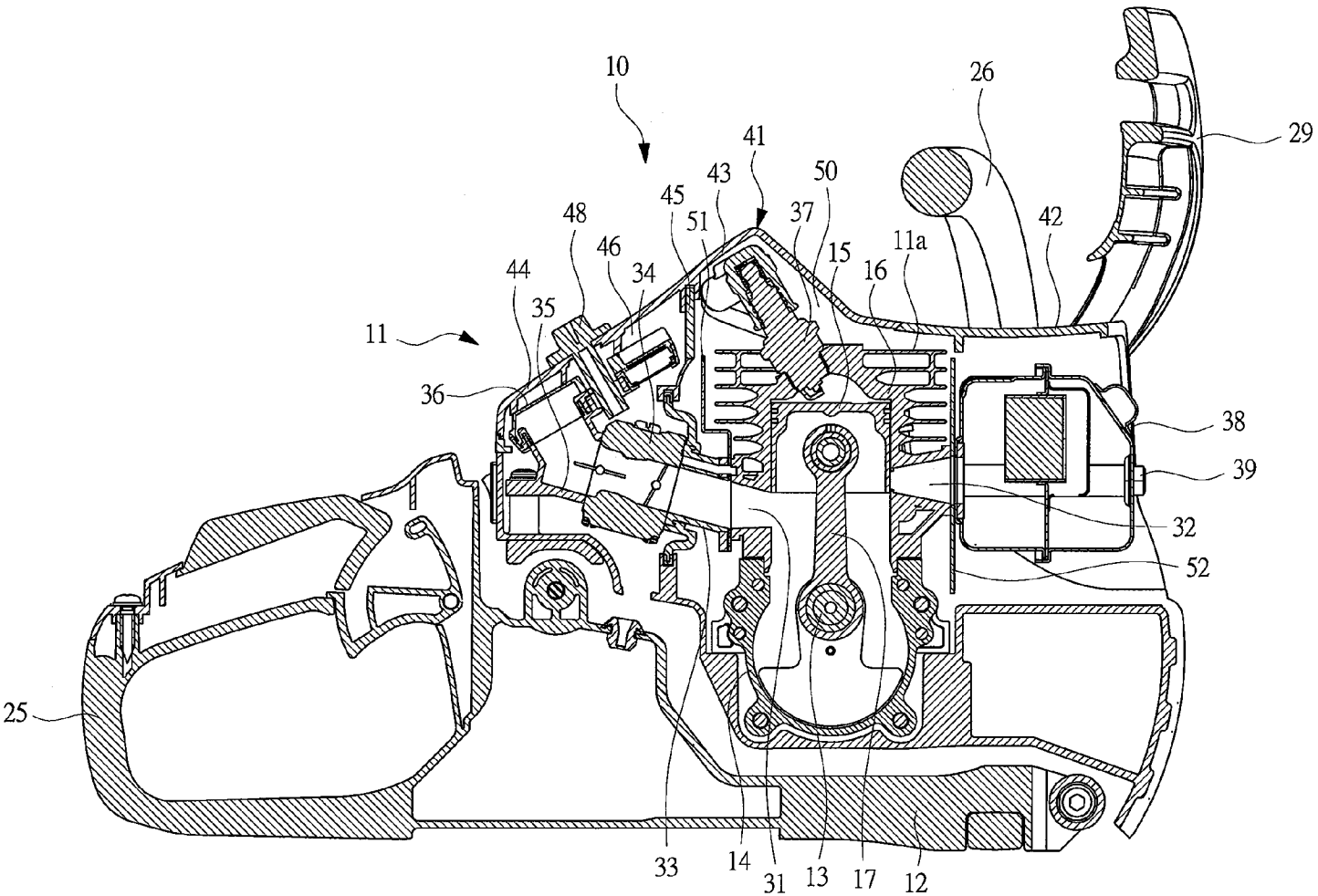
FIG. 4 is a cross-sectional view along the line A-A in FIG. 2.

As illustrated in FIG. 4, in the cylinder 16, an intake opening 31 is formed toward the rear side of the power-tool main body 12 in a direction perpendicular to the crankshaft 13, and, on the opposite side of the intake opening 31, an exhaust opening 32 is formed toward the front side of the power-tool main body 12. An insulator 33 provided with a flow channel communicated to the intake opening 31 is attached to the cylinder 16, and a vaporizer 34 is attached to the insulator 33. The insulator 33 has heat resistance, is formed of a polymer resin having heat conductivity extremely smaller than that of the cylinder 16, and thus prevents the heat of the cylinder 16 from being transmitted to the vaporizer 34. A supporting part 35 is provided on the inlet side of the vaporizer 34, and a filter element 36 is attached to the supporting part 35. External air, which has been purified by the filter element 36, and fuel from a not-illustrated fuel tank are supplied to the vaporizer 34, air-fuel mixture (vapor) of the air and fuel is generated by the vaporizer 34, and the air-fuel mixture is supplied into the engine main body 11*a* from the intake opening 31. The supplied air-fuel mixture is ignited by a spark plug 37. A muffler 38 is attached to the cylinder 16 by a bolt 39 so as to be communicated to the exhaust opening 32, and a combustion gas exhausted from the exhaust opening 32 is exhausted to the outside via the muffler 38.

The engine main body 11*a* is covered with an engine cover 41. A gap is provided between the engine cover 41 and the front handle 26. The front handle 26 is provided so as to cross the engine cover 41 via the gap. The engine cover 41 includes the cover main body 42 and a cylinder cover 43 attached to the cylinder cover 43, and the cylinder cover 43 covers a top part of the cylinder 16. The cylinder cover 43 is integrated with a cleaner cover part 44. The filter element 36 is covered with the cleaner cover part 44. A heat shielding plate 45 is provided between the insulator 33 and the vaporizer 34. The heat shielding plate 45 and the cleaner cover part 44 form a vaporizer chamber part 46. The vaporizer 34 is housed in the vaporizer chamber part 46. As a result of building the vaporizer 34 in the vaporizer chamber part 46, woodchips, dust, etc. are prevented from flowing into the vaporizer 34, and thus taint damage of the vaporizer 34 and the filter element 36 is suppressed. The cylinder cover 43 is attached to the engine 11 by a fixing screw 48 disposed at the cleaner cover part 44.

As illustrated in FIG. 2, a discharge opening 18*a* of the cooling fan 18 is formed toward the cylinder cover 43, and forcible cooling winds generated by the cooling fan 18 are discharged toward the cylinder cover 43. To guide the forcible cooling winds, which have been discharged toward the cylinder cover 43 toward the opposite side of the cooling fan 18, i.e., toward an emission opening 49 provided in the tool-driving-side end between the cylinder cover 43 and the cylinder 16 as illustrated in FIG. 4, a heat-dissipating plate 51 on the intake side is attached to a side surface of the cylinder 16 on the intake opening 31 side, and a heat-dissipating plate 52 on the exhaust side is attached to a side surface of the cylinder 16 on the exhaust opening 32 side. The heat-dissipating plate 51 of the intake side is abutting a periphery of the opening of the intake opening 31 and is attached to the cylinder 16. The insulator 33 is attached to the cylinder 16 via the heat-dissipating plate 51. The heat-dissipating plate 51 is preferable to be formed of a metal plate of, for example, an aluminum alloy as a material that has thermal conductivity higher than that of the insulator 33. The heat-dissipating plate 51 can be easily formed by cutting a thin metal plate into a shape by pressing and bending it at about 90 degrees. The heat-dissipating plate 51 is extending toward the cylinder cover 43 along the cylinder 16 and is extending to the tool-driving-side end side of the crankshaft 13 along the crankshaft 13. On the other hand, the heat-dissipating plate 52 of the exhaust side is abutting a periphery of the opening of the exhaust opening 32 and is attached to the cylinder 16, and the muffler 38 is attached to the cylinder 16 via the heat-dissipating plate 52. The heat-dissipating plate 52 is extending toward the cylinder cover 43 and is extending to the tool-driving-side end side of the crankshaft 13 along the crankshaft 13. Both of the heat-dissipating plates 51 and 52 and the cylinder 16 form a cylinder cooling chamber part 50, and the forcible cooling winds are discharged to the outside from the emission opening 49 through the cylinder cooling chamber part 50.

In this manner, the heat-dissipating plate 51 on the intake side is abutting a periphery of the opening of the intake opening 31 and is attached to the cylinder 16. Therefore, the heat in the vicinity of the intake opening 31 of the cylinder 16 can be dissipated by the heat-dissipating plate 51. As a result, temperature increase of the insulator 33 can be effectively suppressed, and temperature increase of the vaporizer 34 can be suppressed. Moreover, since the heat-dissipating plate 51 is disposed between the insulator 33 and the cylinder 16, the heat-dissipating plate 51 can be easily attached to the cylinder 16 by using a part for attaching the insulator 33 without the need of a part for attaching the heat-dissipating plate 51 to the cylinder 16.

The heat-dissipating plate 52 on the exhaust side is attached between the muffler 38 and the cylinder 16. Therefore, the heat-dissipating plate 52 can be easily attached to the cylinder 16 by using a part for attaching the muffler 38 to the cylinder 16 without the need of apart for attaching the heat-dissipating plate 52 to the cylinder 16. While the heat-dissipating plate 52 is away from the intake opening 31, since the heat-dissipating effect of the cylinder 16 can be obtained, temperature increase of the insulator 33 can be effectively suppressed as a result, the heat transmitted to the vaporizer 34 via the insulator 33 can be reduced, and temperature increase of the vaporizer 34 can be suppressed. Therefore, although the heat-dissipating plate 51 on the intake side and the heat-dissipating plate 52 on the exhaust side are provided along the cylinder 16 in the engine 11 as illustrated in the drawings, temperature increase of the vaporizer 34 can be suppressed by either one of a configuration in which only the heat-dissipating plate 51 of the intake side is disposed and a configuration in which only the heat-dissipating plate 52 of the exhaust side is disposed. However, the temperature increase of the vaporizer 34 can be more suppressed by the configuration in which the heat-dissipating plate 51 of the intake side is provided.

As illustrated in FIG. 2, the heat-dissipating plate 51 on the intake side has a base part 51*a* extending in a direction along the crankshaft 13, and a tip of the base part 51*a* is projecting more than a lateral side 43*b* on the emission opening 49 side of the cylinder cover 43, and the projecting part serves as an exposing part 53 having its upper side being exposed to outside air. At least a part of the heat-dissipating plate 51 is not overlapped with the cylinder cover 43 by providing the exposing part 53 in the heat-dissipating plate 51. A tip guide part 51*b* extending in a transverse direction with respect to the crankshaft 13 is integrally provided with the tip part of the base part 51*a* of the heat-dissipating plate 51, and the tip guide part 51*b* is extending from the base part 51*a* toward the muffler 38 and constitutes the exposing part 53. When the tip of the base part 51*a* is provided with the tip guide part 51*b* in this manner, the area of the exposing part 53 can be increased, and the heat-dissipating effect can be enhanced as compared with the case in which the tip guide part 51*b* is not provided. Moreover, the cooling winds blown from the cooling fan 18 side toward the cylinder 16 can be caused to turn around toward the tool-driving-side end side by the tip guide part 51*b*, and the effect of forcible cooling during engine drive can be enhanced.

As illustrated in FIG. 2, the heat-dissipating plate 52 of the exhaust side has a base part 52*a* extending in a direction along the crankshaft 13, and a tip of the base part 52*a* is projecting more than a lateral side 43*b* of the cylinder cover 43, and the projecting part serves as an exposing part 53 exposed to outside air. At least a part of the heat-dissipating plate 52 is not overlapped with the cylinder cover 43 by providing the exposing part 53 in the heat-dissipating plate 52. A tip guide part 52*b* extending in a transverse direction with respect to the crankshaft 13 is integrally provided to the tip of the base part 52*a* of the heat-dissipating plate 52, and the tip guide part 52*b* is extending from the base part 52*a* so as to cover the muffler 38. When the tip of the base part 52*a* is provided with the tip guide part 52*b* in this manner, the area of the exposing part 53 can be increased, and the heat-dissipating effect can be enhanced as compared with the situation in which the tip guide part 52*b* is not provided.

Figure 1:
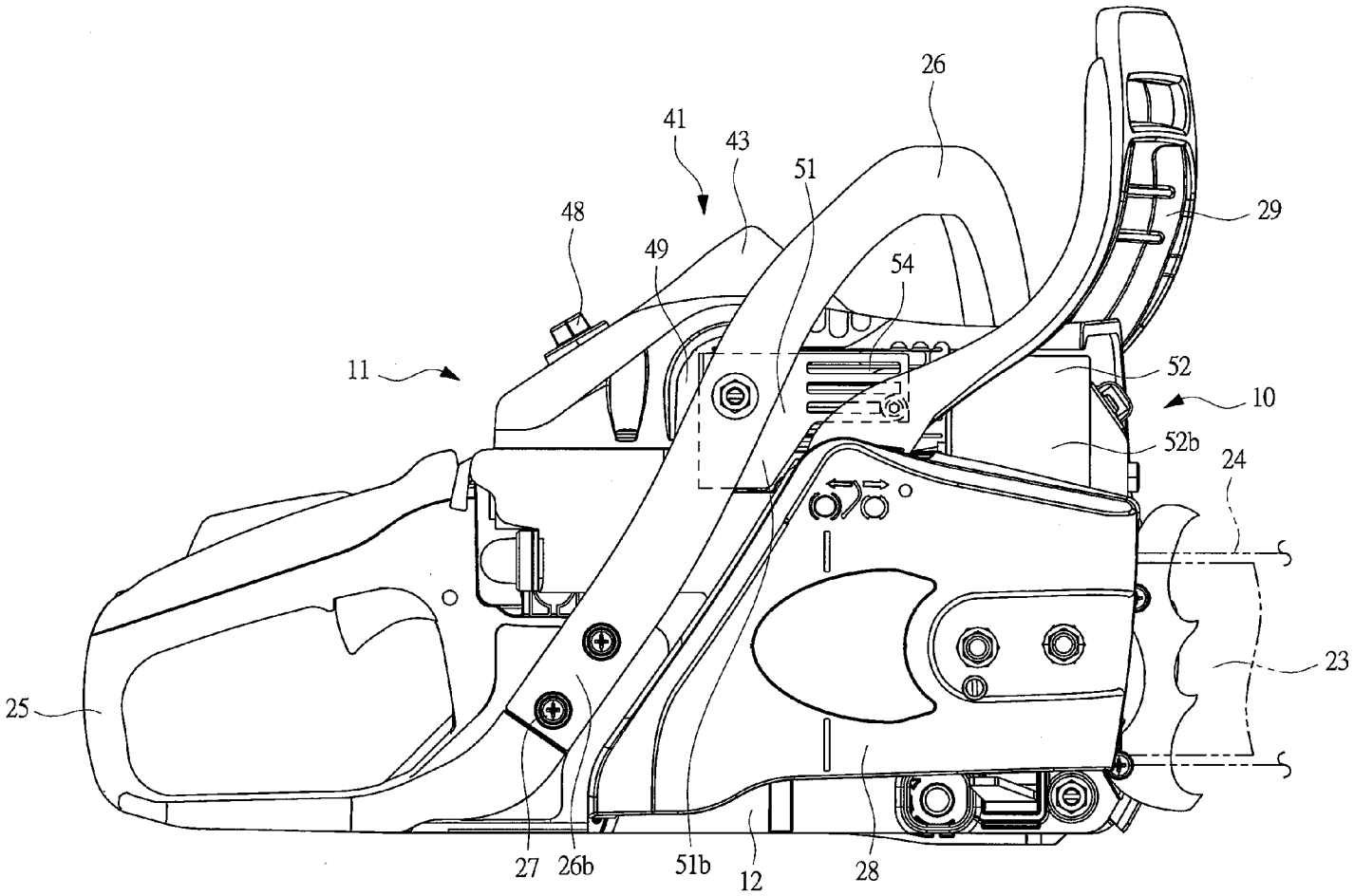
FIG. 1 is a front view illustrating a part of a chain saw serving as an engine power tool.
Figure 3:
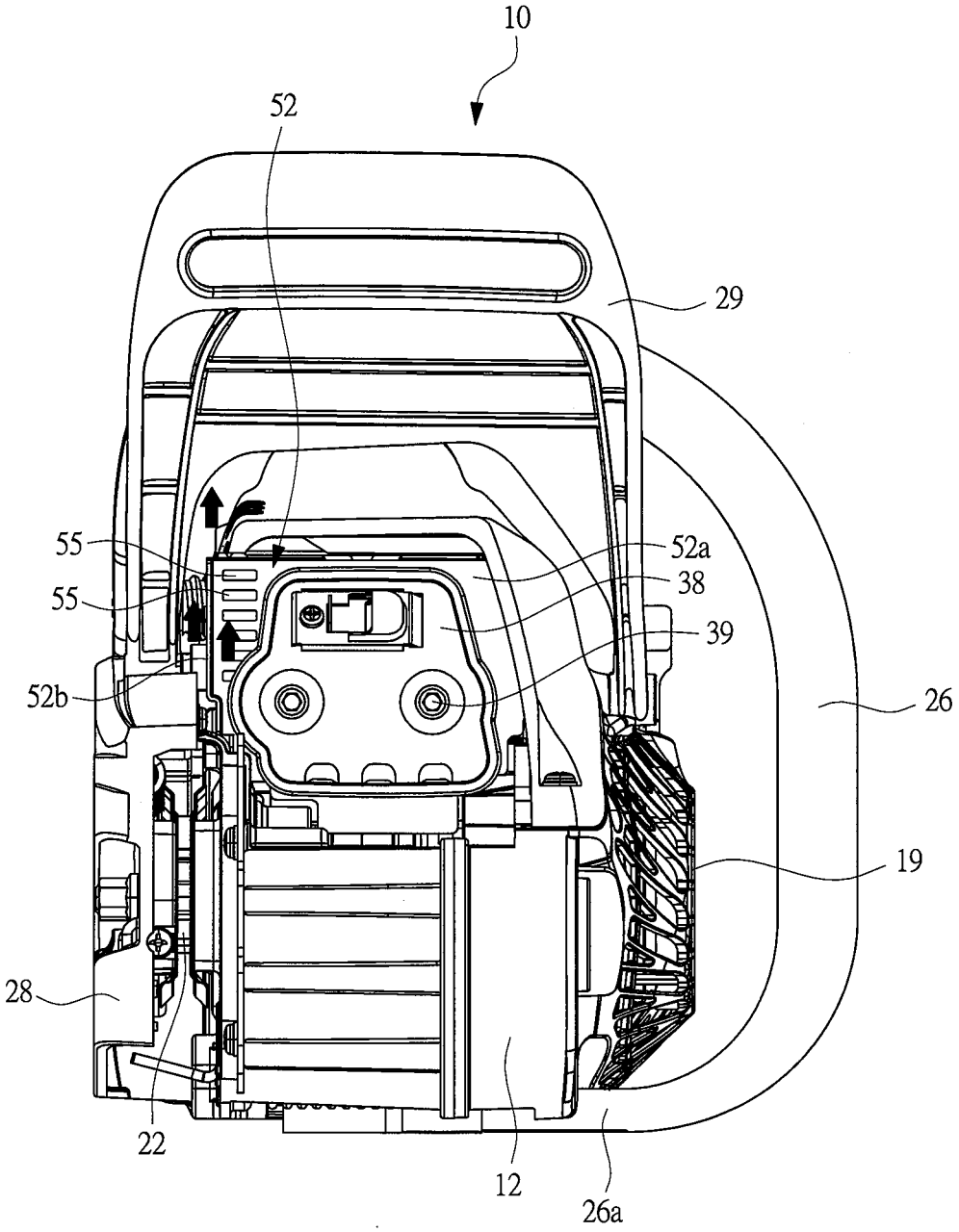
FIG. 3 is a right side view of FIG. 1.

As illustrated in FIG. 1, a plurality of exhaust opening parts 54 for discharging cooling winds to outside are provided to the tip guide part 51*b* of the heat-dissipating plate 51 on the intake side, and a part of the cooling winds guided toward the tool-driving-side end by the tip guide part 52*b* is discharged from the exhaust opening parts 54. As illustrated in FIG. 3, a plurality of exhaust opening parts 55 for discharging the cooling winds to the part between the tip guide part 52*b* and the muffler 38 are provided to the base part 52*a* of the heat-dissipating plate 52 on the exhaust side, the cooling winds flowing between both of the base parts 51*a* and 52*a* can be guided toward the tool-driving-side end side, and the cooling effect of the engine 11 can be enhanced.

When the engine 11 is driven, airstreams are generated by the rotation of the cooling fan 18. The airstreams are guided to the cooling-wind discharge opening 18*a*, and, as illustrated by arrows in FIG. 2, forcible cooling winds discharged from the cooling-wind discharge opening 18*a* are guided to the cylinder 16 by the engine cover 41, cools the cylinder 16, and then is discharged to outside from the emission opening 49. In this process, first, the forcible cooling winds flow from the cooling-wind discharge opening 18*a* to the upper side and are deflected toward the cylinder 16 by the cylinder cover 43. Then, as illustrated by the arrows in FIG. 2, the forcible cooling winds collide with the exposing part 53 of the heat-dissipating plate 51 through the cylinder cooling chamber part 50 between the heat-dissipating plates 51 and 52 and are discharged to the outside through the part between the tip guide part 51*b* and the heat-dissipating plate 52. The forcible cooling winds which have collided with the heat-dissipating plate 51 are guided from the vaporizer chamber part 46 side to the cylinder 16 side by the wind-guiding ribs (exhaust opening part) 54 and go toward a front lateral part of the cylinder 16. As a result, the forcible cooling winds are prevented from passing through the part between the cylinder 16 and the vaporizer chamber part 46 and being discharged to outside without cooling the cylinder 16, the cooling winds are reliably guided toward the cylinder 16, and forcible cooling of the engine 11 is effectively carried out.

In this manner, tip parts of the heat-dissipating plates 51 and 52 provided at the engine 11 that drives the chain saw 10 serving as an engine power tool are bulged from the lateral side 43*b* of the cylinder cover 43 and serve as the exposing parts 53. Not only in the situation in which the cylinder 16 is forcedly cooled by the cooling fan 18, but also in the situation in which the engine 11 is stopped and there is no cooling wind, the exposing part 53 facilitates heat dissipation of the cylinder 16 by the heat-dissipating plates 51 and 52. Therefore, even when the engine 11 is stopped to stop the flow of the air-fuel mixture in the vaporizer 34 and the insulator 33 and the cooling effects of the vaporizer 34 and the insulator 33 brought about by the air-fuel mixture disappear, heat dissipation of the cylinder 16 can be carried out by the heat-dissipating plates 51 and 52. Therefore, temperature increase of the vaporizer 34 can be suppressed, and the engine 11 can be reliably re-started.

Particularly, in an engine power tool such as a chain saw or a power cutter, the front handle 26 is provided above the cylinder 16, and the top part of the cylinder 16 is covered with the cylinder cover 43 in order not to only protect the engine 11 from a large amount of woodchips and dust generated in an operation of cutting a working object, but also to protect the hands and arms of the operator who holds the front handle 26. In the chain saw or the power cutter, it has been general that the front handle 26 is disposed so as to surround the engine from the tool-driving-side end of the engine 11 to the fan-driving-side end, and it has been general that the tool-driving-side end of the front handle 26 is provided so as to be closer to but does not contact the engine 11 so that the tool-driving-side end cannot be easily held. Therefore, in the existing chain saw or the power cutter, natural air cooling of the engine 11 has not been able to be reliably carried out. On the other hand, as a result of exposing a part of the heat-dissipating plates 51 and 52 to outside like the present invention, the heat-dissipating plates 51 and 52 are caused to project to the tool-driving-side leg part 26*b* of the front handle 26, which is not held by the operator, while the top part of the cylinder 16 is covered with the cylinder cover 43 so as to expose the projecting parts to the outside and cause the heat-dissipating plates 51 and 52 to have the structures open to the air. Therefore, the natural convection generated from the heat-dissipating plates 51 and 52 is prevented from being disturbed by the cylinder cover 43 while the hands of the operator are protected from the heat of the cylinder 16, and natural air cooling of the cylinder 16 can be facilitated.

The present invention is not limited to the above-described embodiment, and various modifications can be made within a range not departing from the gist of the present invention. For example, the above-described embodiment adopts the structure in which the heat-dissipating plates 51 and 52 are projecting from the cylinder cover 43; however, as long as the natural convection is not disturbed, the structure is not limited thereto. The lateral side of the cylinder cover 43 may be extended to the tool-driving-side end side, an opening may be provided in the extended part, and the exposing parts 53 of the heat-dissipating plates 51 and 52 may face the opening. Even when the structure is used, natural heat dissipation of the heat-dissipating plates 51 and 52 can be facilitated at the positions that do not have influence even when the front handle 26 is held; therefore, the cooling effect of the engine 11 can be enhanced. The engine 11 is mounted on the chain saw 10 serving as the engine power tool; however, the engine illustrated in the drawings can be also used as an engine of a power cutter.

What is claimed is:

1. An engine having an engine main body including a crankcase in which a crankshaft is rotatably built and a cylinder in which a piston is reciprocatably built and coupled to the crankshaft via a connecting rod, the engine comprising:

a cylinder cover covering a top part of the cylinder;

a cooling fan attached to a projecting end of the crankshaft and rotatably driven by the crankshaft; and a first heat-dissipating plate provided to extend from a periphery of the cylinder toward an end on an opposite side of the projecting end of the crankshaft, wherein the first heat-dissipating plate includes:

a base part extending in a direction along the crankshaft; and a tip guide part exposing an upper side and provided at a tip of the base part, extending in a transverse direction with respect to the crankshaft, and the first heat-dissipating plate is disposed between an exhaust opening side of the cylinder and a muffler.

2. The engine according to claim 1, wherein the tip guide part is more bulged to the outside than a vicinity of a lateral side or a lateral side of the cylinder cover.

3. The engine according to claim 1, wherein a handle part extending in a direction of the crankshaft is provided above the cylinder cover.

4. The engine according to claim 1, wherein the base part is provided to extend along the cylinder from the projecting end of the crankshaft toward the end on the opposite side and guides a cooling wind generated by the cooling fan.

5. The engine according to claim 1, wherein the tip guide part forms a cooling-air emission part between the tip guide part and the lateral side of the cylinder cover.

6. The engine according to claim 1, further comprising a second heat-dissipating plate disposed between an intake opening of the cylinder and an insulator.

7. The engine according to claim 6, wherein the second heat-dissipating plate includes: a base part extending in a direction along the crankshaft; and a tip guide part provided at a tip of the base part, extending in a transverse direction with respect to the crankshaft.

8. The engine according to claim 1, wherein an exhaust opening part for discharging a cooling wind is provided to the first heat-dissipating plate.

9. The engine according to claim 6, wherein an exhaust opening part for discharging a cooling wind is provided to the second heat-dissipating plate.

10. An engine power tool comprising a rotating tool rotationally driven by the crankshaft, wherein the rotating tool is rotationally driven by the engine according to claim 1.

* * * * *